US007484505B1

(12) United States Patent
Saunders

(10) Patent No.: US 7,484,505 B1
(45) Date of Patent: Feb. 3, 2009

(54) COLLAPSIBLE LOCKING SLINGSHOT

(75) Inventor: Charles Saunders, Columbus, NE (US)

(73) Assignee: Saunders Archery Company, Columbus, NE (US)

( * ) Notice: Subject to any disclaimer, the term of this patent is extended or adjusted under 35 U.S.C. 154(b) by 375 days.

(21) Appl. No.: 11/302,792

(22) Filed: Dec. 14, 2005

Related U.S. Application Data

(60) Provisional application No. 60/638,547, filed on Dec. 22, 2004.

(51) Int. Cl.
*F41B 3/02* (2006.01)

(52) U.S. Cl. ..... 124/20.1

(58) Field of Classification Search ..... 124/20.1, 124/20.2, 20.3
See application file for complete search history.

(56) References Cited

U.S. PATENT DOCUMENTS 344,840 A * 7/1886 Lester ..... 124/20.1
2,672,857 A * 3/1954 Gauthier ..... 124/20.1
4,273,094 A 6/1981 Hogan
4,274,387 A * 6/1981 McBride ..... 124/20.2
4,722,316 A 2/1988 Stinnett et al.
4,911,136 A 3/1990 Brown
5,230,323 A 7/1993 Saunders et al.
5,345,922 A 9/1994 Ott
5,501,207 A 3/1996 Blank
5,894,672 A * 4/1999 Ellenburg et al. ..... 33/265
6,786,213 B1 9/2004 Lee
6,968,835 B2 * 11/2005 Lee ..... 124/20.1

* cited by examiner

*Primary Examiner*—John Ricci
(74) *Attorney, Agent, or Firm*—Levenfeld Pearlstein, LLC

(57) ABSTRACT

The present invention provides for a collapsible locking slingshot having a quick-release interchangeable band replacement and safety system. The present invention also includes a self-centering, open-pocket slingshot pouch and a unique dual-tapered band. The slingshot collapses into a lockable case, improving the slingshot's safety, and enhancing the protection and longevity of the slingshot's components. The slingshot incorporates a unique shoot-over design in which the arms generally are parallel to the shooter's arm during operation.

11 Claims, 11 Drawing Sheets

COLLAPSIBLE LOCKING SLINGSHOT

CROSS-REFERENCE TO RELATED APPLICATIONS

This application claims the benefit of U.S. Provisional Application 60/638,547.

FIELD OF THE INVENTION

The present invention relates generally to slingshots and their components and, more particularly, to a collapsible locking slingshot with a unique quick-release interchangeable band replacement and safety system. The present invention also relates to a self-centering, open-pocket slingshot pouch and an improved dual-tapered band.

BACKGROUND OF THE INVENTION

Slingshots commonly are used as toys, for recreation, and for hunting. Although slingshots have existed for centuries, the basic design and mechanics have remained constant over time. Quite simply, a traditional slingshot comprises a handle and a pair of arms extending divergently upward from the handle. An elastic band is attached between the arms. Typically, centered on the elastic band is a pouch designed to hold a projectile. After a projectile is placed in the pouch, the pouch is pulled backwards, away from the arms, thereby extending and stretching the elastic band to create potential energy. When the pouch is released, the potential energy of the elastic band is transformed to kinetic energy which is transferred to the projectile through the pouch. The projectile then is thrust forward, out of the pouch, and away from slingshot shooter and toward a desired target.

Various design enhancements have been made over the years in an attempt to improve the functionality and safety of slingshots. For example, such improved slingshot devices include wrist-braces to help stabilize shots, foldable designs to make devices more portable, aiming mechanisms to improve accuracy, multi-band designs to improve band life and increase shot speed, and pulley assemblies to produce maximum projectile velocity with minimum force exertion by the user. Despite the various improvements made to slingshots over the years, there still exists a need for a slingshot which is collapsible and lockable, which has a quick-release band replacement system, and which may include a self-centering, open-pocket pouch and dual-tapered band. The present invention satisfies that need.

BRIEF SUMMARY OF THE INVENTION

The unique design of the components of the slingshot of the present invention creates several performance and safety features never before seen in a slingshot device. First, the slingshot of the present invention collapses or folds into a lockable case. This feature not only improves the slingshot's safety, but it also enhances protection and longevity of the slingshot's components by creating a protected inner case that shields the delicate elastic band from abrasion and ultraviolet radiation. Second, the slingshot of the present invention uses a unique shoot-over design in which the arms are substantially parallel (rather than generally perpendicular) to the shooter's arm during operation. This shoot-over design allows the band to dissipate any post-firing residual energy in a more safe and controlled manner than in prior slingshot designs. Third, the slingshot of the present invention utilizes a quick-release band replacement and safety mechanism which is engineered to accept both flat and tubular bands, permit rapid band replacement, and allow for safe disengagement of the mechanism in the event of band or component failure. Additionally, the slingshot of the present invention can incorporate a unique self-centering, open-pocket pouch design that increases shot speed and accuracy by minimizing side contact between the pouch and the ammunition. Finally, the slingshot of the present invention can include a uniquely-engineered dual-tapered band design which decreases band wear while maintaining virtually all of the speed and pull smoothness associated with traditional tapered band designs.

It is therefore a principal object of the present invention to provide a slingshot with improved safety and performance features. An additional principal object of the present invention is to provide a collapsible, folding slingshot which is compact and which protects the delicate band from abrasion and ultraviolet radiation. Another object of the invention is to provide a collapsible, folding slingshot which may be locked in a folded position to prevent the slingshot from being used. A further object of the present invention is to provide a slingshot which, when unfolded, transforms into a gauntlet-shaped brace designed to protect the shooter's hand, wrist, and arm. Yet another object of the present invention is to provide a slingshot with a gauntlet-shaped brace designed to stabilize and align the pulling forces to create a straighter shot and reduce gripping pressure. It is another object of the present invention to provide a slingshot which has ideal handle/brace ergonomics, without the need for high hand strength or retainer straps, which keeps the slingshot from twisting out of the shooter's hand. Another object of the present invention is to provide a slingshot with a shoot-over design which minimizes the recoil and shock to the shooter's hand and arm, and which permits residual energy in the band to be safely dispersed away from the shooter and the slingshot's components. A further object of the present invention is to provide a slingshot with a large, internally embedded, metal-core axis, which permits the slingshot to be detected by metal detectors.

An important object of the present invention is to provide a quick release band replacement and safety system which minimizes the time required to change a slingshot band, while maximizing safety by utilizing a groove-and-clip design engineered to eject the clip forward, away from the shooter, should a slingshot component fail during pull-back. Yet another object of the present invention is to provide a slingshot with a quick release band replacement and safety system which can utilize by flat bands and tubular bands. A further object of the present invention is to provide a slingshot design with a quick release band replacement and safety system that includes means to adjust the band length, from long to short or any length in between, to achieve the fastest speed, the easiest pull, and/or the greatest band life.

An additional object of the present invention is to provide a slingshot which is designed with engineered failsafe break points to maximize protection of the shooter in case of component failure. Another object of the present invention is to provide a slingshot which is easy to assemble, use, fold, unfold, and lock.

Yet another object of the present invention is to provide a dual-tapered band which is designed to maintain the ease-of-pull and high velocity of conventional tapered bands, while at the same time decreasing the wear of the band by focusing the band's flexing away from the pouch.

An additional object of the present invention is to provide a self-centering, open-pocket pouch which includes integrated exit ports to permit the ammunition to exit the pouch without touching the sides of the pouch, thereby increasing the speed and accuracy of shooting a single or multiple ammunition load. It is another object of the present invention to provide a self-centering, open-pocket pouch which is molded flat to help the pouch open with air pressure to ensure the ammunition exits the pouch cleanly.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
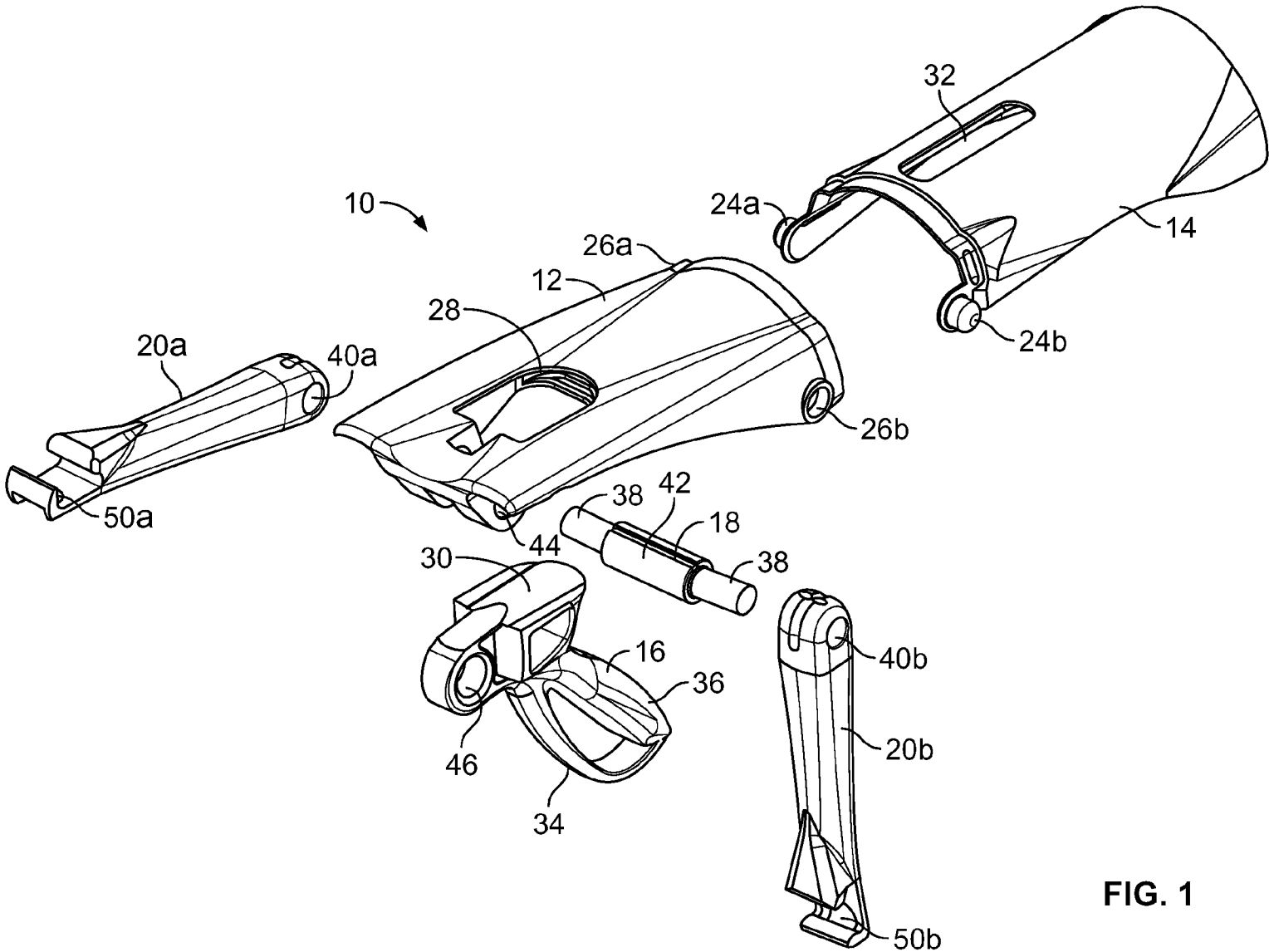
FIG. 1 is an exploded view of a collapsible locking slingshot of the present invention, showing the front panel, rear panel, handle, axle, and arms.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

A collapsible locking slingshot of the present invention is comprised of a ten primary components: a front panel, a rear panel, a handle, an axle, a pair of arms, a pair of locking clips, a dual-tapered band, and a self-centering open-pocket pouch. It will be appreciated, however, the collapsible locking slingshot device itself (comprising only the front panel, rear panel, handle, axle, arms, and locking clips) is independent from the dual-tapered band and the self-centering, open-pocket pouch. Although the band and pouch designs disclosed herein are intended to complement the particular collapsible locking slingshot device disclosed herein, the band and pouch of the present invention also may be used with other prior art slingshot devices. Similarly, the particular collapsible locking slingshot device of the present invention may be used with prior art bands (single, multiple, flat, tubular, etc.) and pouches.

Collapsible Locking Slingshot

Figure 2:
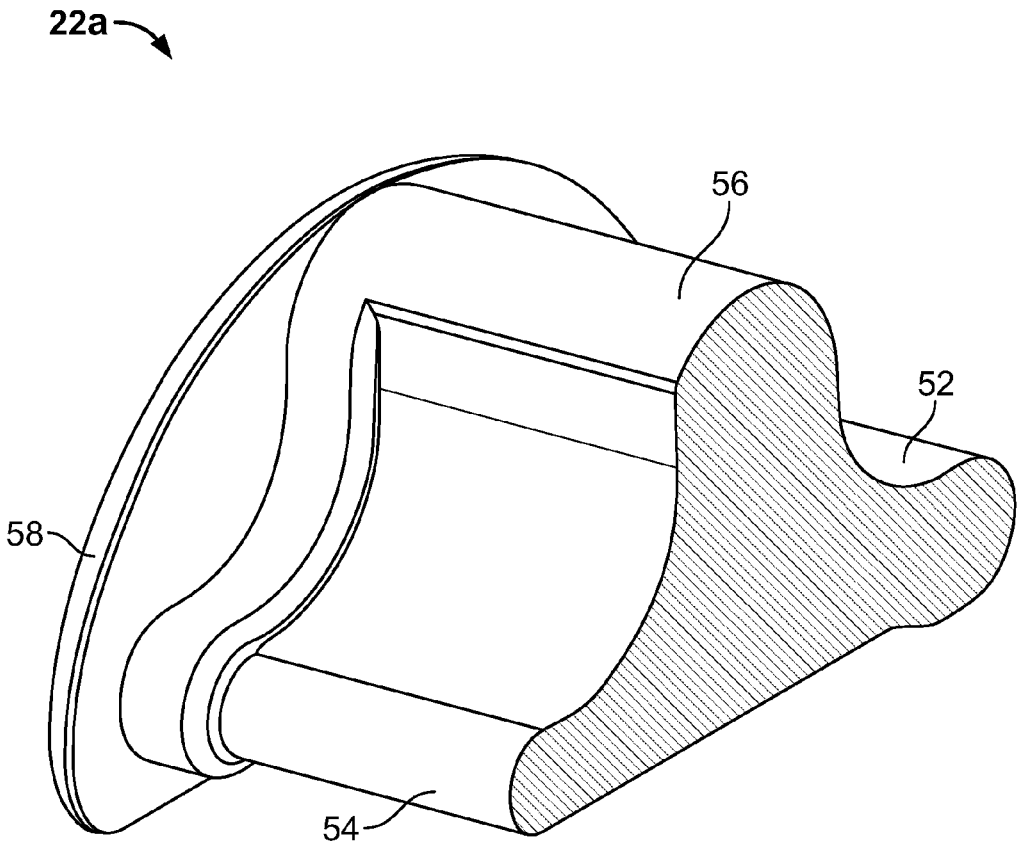
FIG. 2 is a perspective cross-sectional view of a locking clip of the collapsible locking slingshot of the present invention showing small and large diameter sides of the clip used for securing tubular and flat bands, respectively.

As shown in FIGS. 1, 2, and 3 the collapsible locking slingshot device 10 of the present invention is comprised of a front panel 12, a rear panel 14, a handle 16, an axle 18, a pair of arms 20*a* and 20*b*, and a pair of locking clips 22*a* and 22*b* (locking clips 22*a* and 22*b* are identical and, therefore, only locking clip 22*a* is depicted in the enlarged drawing shown in FIG. 2). In the preferred embodiment, the front panel 12, the rear panel 14, the handle 16, the arms 20*a* and 20*b*, and the locking clips 22*a* and 22*b* are constructed of a rigid, light-weight plastic material. The front panel 12 and the rear panel 14 are designed to be generally gauntlet-shaped so as to surround and shield the top surface of a shooter's arm when in the opened on un-collapsed configuration. The front panel 12 and the rear panel 14 are connected via a hinged connection, which is created by nubs 24*a* and 24*b* defined in the rear panel 14 mating with holes 26*a* and 26*b* in the front panel 12. The front panel 12 is further comprised of an integrated port 28 designed to accept an upper portion 30 of the handle 16 when the slingshot is in a fully-collapsed configuration. The rear panel 14 is further comprised of an integrated port 32 designed to accept a part 34 of a lower portion 36 of the handle 16 when the slingshot is in a fully-collapsed configuration.

The ends 38 of the axle 18 slide into bores 40*a* and 40*b* defined on the arms 20*a* and 20*b*. The center portion 42 of the axle 18 slides through an aperture 44 on the front panel 12 and a bore 46 on the handle 16, thereby connecting the arms 20*a* and 20*b* and handle 16 to the front panel 12. It is contemplated that the arms 20*a* and 20*b* and the handle 16 are each rotatably connected to the axle allowing for independent rotation thereof. Alternatively, the arms may be secured to the axle and will rotate with the rotation of the axle therefore the arms will always be in alignment with each other.

Positioned at the other end of the arms 20*a* and 20*b* are grooves 50*a* and 50*b*, which are designed to matingly engage the locking clips 22*a* and 22*b*. The locking clips 22*a* and 22*b* (illustrated in FIGS. 3*a*-3*e*) are generally semi-circular in shape and are comprised of three main integrated elements: a large-diameter end 52 designed to secure flat bands, a small diameter end 54 design to secure tubular bands (which, generally, are thicker than flat bands), and a grip 56 designed to facilitate engagement and removal of the locking clips 22*a* and 22*b* within the grooves 50*a* and 50*b*. This groove-and-clip design is capable of utilizing flat or tubular, single or multiple bands. If the large-diameter end 52 of the clips is facing forward when the clips are inserted into the grooves, then a thicker band (small tubular bands or thicker flat bands) may be used, and if the small diameter end 54 is facing forward, then thinner bands may be used. Each clip includes a pair of outside plates 58 that help guide the clips into proper position within the grooves.

Figure 3A:
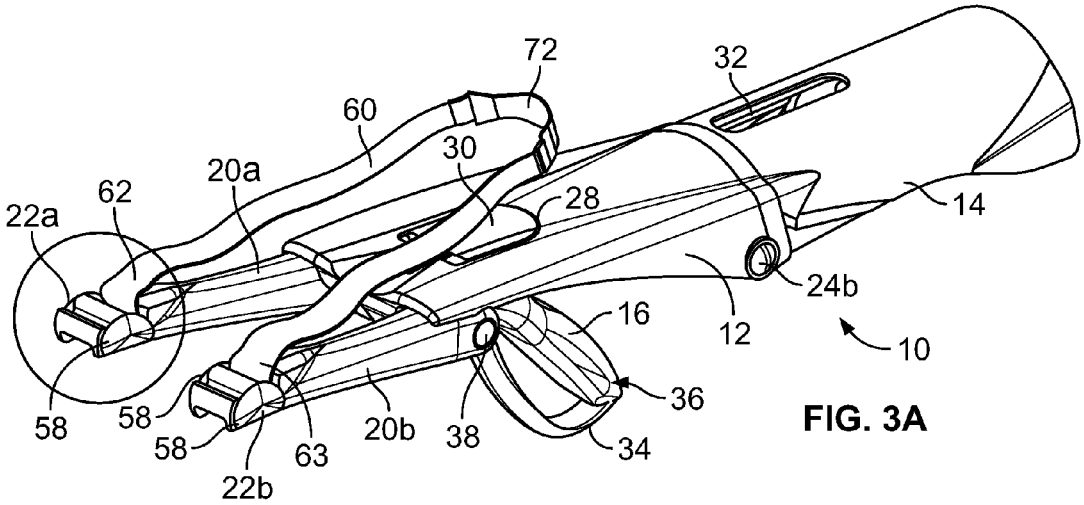
FIG. 3*a* is a perspective view of the collapsible locking slingshot of the present invention showing the fully-assembled slingshot, band, and pouch.
Figure 3B:
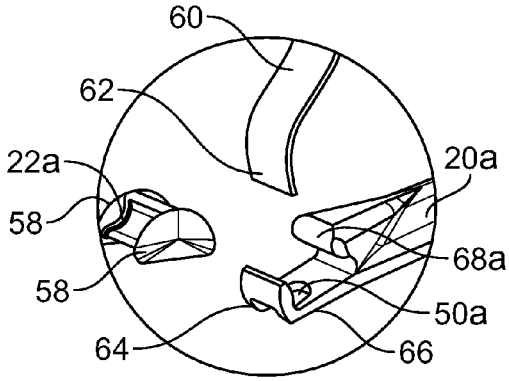
FIGS. 3*b*-3 *e* are perspective views showing the steps to engage the locking clip into the arm to secure the band.
Figure 3D:
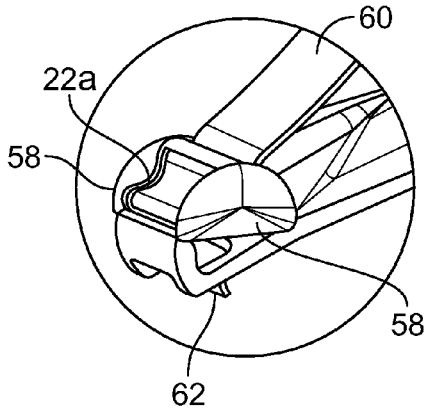
Figure 3C:
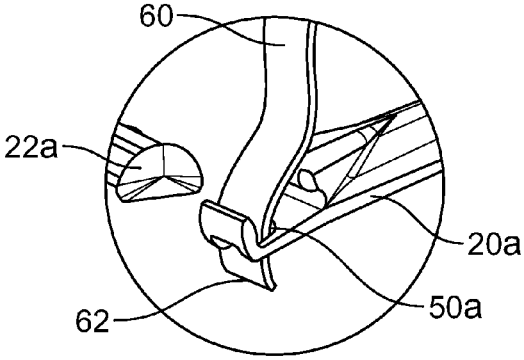
Figure 3E:
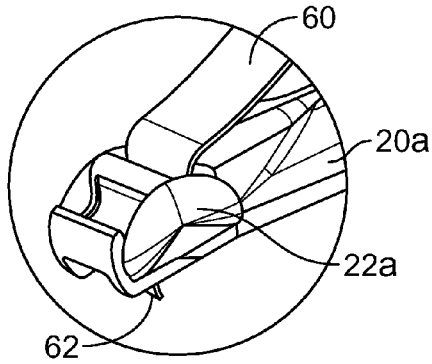

The fully assembled collapsible locking slingshot appears in FIG. 3*a* along with an illustrated guide (FIGS. 3*b*-3*e*) showing installation of a band 60 using the clips 22*a* and 22*b* in conjunction with the grooves 50*a* and 50*b*. To install the band 60, a user positions one end 62 of the band 60 into groove 50*a* and the other end 63 of the band 60 into groove

50*b*. The ends of the band 60 may pass through an opening 64 in the bottom portion 66 of the groove 50*a*. The locking clip 22*a* is then inserted into groove 50*a* and locked into position. The clips are locked in position by providing an overhang portion 68*a*, 68*b* projecting over the grooves 50*a*, 50*b*, respectively. The clips 22*a*, 22*b* are positioned in the grooves and pushed downwardly past the overhang portion. Thus the clips are snapped locked in a recess created by the walls of the groove and the overhang portion. A similar procedure is followed to secure the other locking clip 22*b* into the other groove 50*b*. This groove-and-clip design creates a quick release band replacement and safety mechanism which is designed to minimize the time required to change a slingshot band. To replace the band 60, a user simply slides the clips 22*a* and 22*b* out of the grooves 50*a* and 50*b*, feeds the new band into the openings 64, and reinserts the clips 22*a* and 22*b* into the grooves 50*a* and 50*b*.

Further, this groove-and-clip design is engineered to eject the clips 22*a* and 22*b* forward, away from the slingshot user, if a portion of the arms 20*a* or 20*b*, or the grooves 50*a* or 50*b*, breaks during pull-back. This minimizes the likelihood of injury due to parts being connected to the band. Once inserted and when the band 60 is pulled back the ends 62 and 63 of the band 60 would exert an outward and forward force on the clips 22*a* and 22*b*. If a break occurs, while the end of the band 60 may thrust backwardly towards the slingshot user, the clip would be forced outwardly and forwardly away from the slingshot user.

A further advantage of the groove-and-clip design of the present invention is that the band 60 can be adjusted and readjusted in length, simply by repositioning the band 60 within the clips 22*a* and 22*b* and the grooves 50*a* and 50*b*. By adjusting the length of the ends 62 and 63 of the band 60 that extends out of the bottom 66 of the grooves 50*a* and 50*b*, but not changing the draw distance between the band anchoring point on the slingshot and the pouch's anchoring point for any particular individual, the most efficient use of the band can be achieved. In the prior art, when band lengths stay the same and anchor points on the slingshot are changed, then generally what changes is the amount of pull. However, by making it quick and easy to change a band from long to short and back to long any number of times, the band can be tuned to shoot at the fastest speed, or for the easiest pull, or at an ideal setting where fastest speed and longest band life are balanced.

Figure 4:
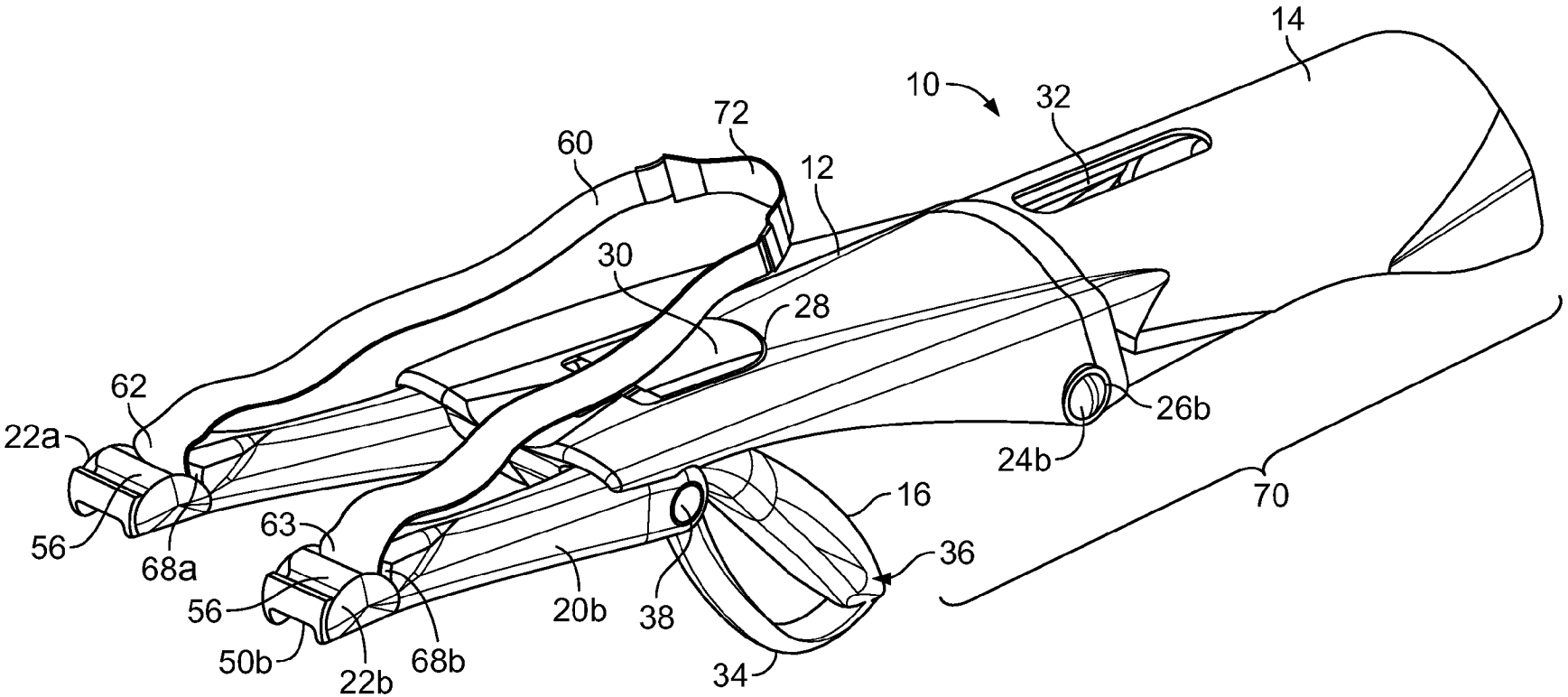
FIG. 4 is a perspective view of the collapsible locking slingshot of the present invention as shown in a fully open configuration, with the rear panel fully extended, the arms fully extended, and the handle fully extended.

In its fully open configuration, shown in FIGS. 3*a* and 4, the collapsible locking slingshot 10 forms a two piece elongated gauntlet-shaped brace 70 which provides many advantages over the prior art. This brace is deeper and longer than prior art slingshots, and rests further back on the user's arm. The extra reach and depth provides much greater bracing stability. Also wrapping further around the user's arm eliminates the need to have a strap locking the wrist brace onto the arm, a common prior art limitation. This extra length and depth also helps keep the pulling forces aligned straight down the slingshot's long axis, thus preventing pull forces from twisting the sling shot out of the user's hand. The present invention's ideal handle/brace ergonomics compensate so well for these forces even a child can hold the slingshot securely and comfortably with only a light grip. Additionally, the design of the collapsible locking slingshot of the present inventions offers the extra user protection of a true gauntlet-style system. Prior art metal-framed slingshots leave the user's arm and hand exposed to injury from improper use.

Finally, the unique shoot over design of the present invention allows the band to dissipate residual energy left over after firing, minimizing recoil or shock to the user's hand and arm. Staged energy dissipation is achieved when the band travels forward without running into other components. For example, the band in the present invention does not run into prior art rearward facing prongs used to hold tubular bands, the post of prior art shoot-over designs, or the band retainer guides on prior art pulley-equipped units. The collapsible locking slingshot 10 employs a pair of arms 20*a* and 20*b* that when in the firing position are substantially parallel to the slingshot user's arm, unlike prior art devices that have the arms perpendicular or at an angle to the user's arm. In the present invention, most, if not all, of the band travels past arms without contacting them. As the band progresses forward its energy is diverted into a downward circular arch, allowing residual energy to dissipate over a much longer stroke than prior art systems. If, by chance, any portion of the band ends up folding into the arms, the arms are designed to gently deflect this peripheral contact.

Figure 5:
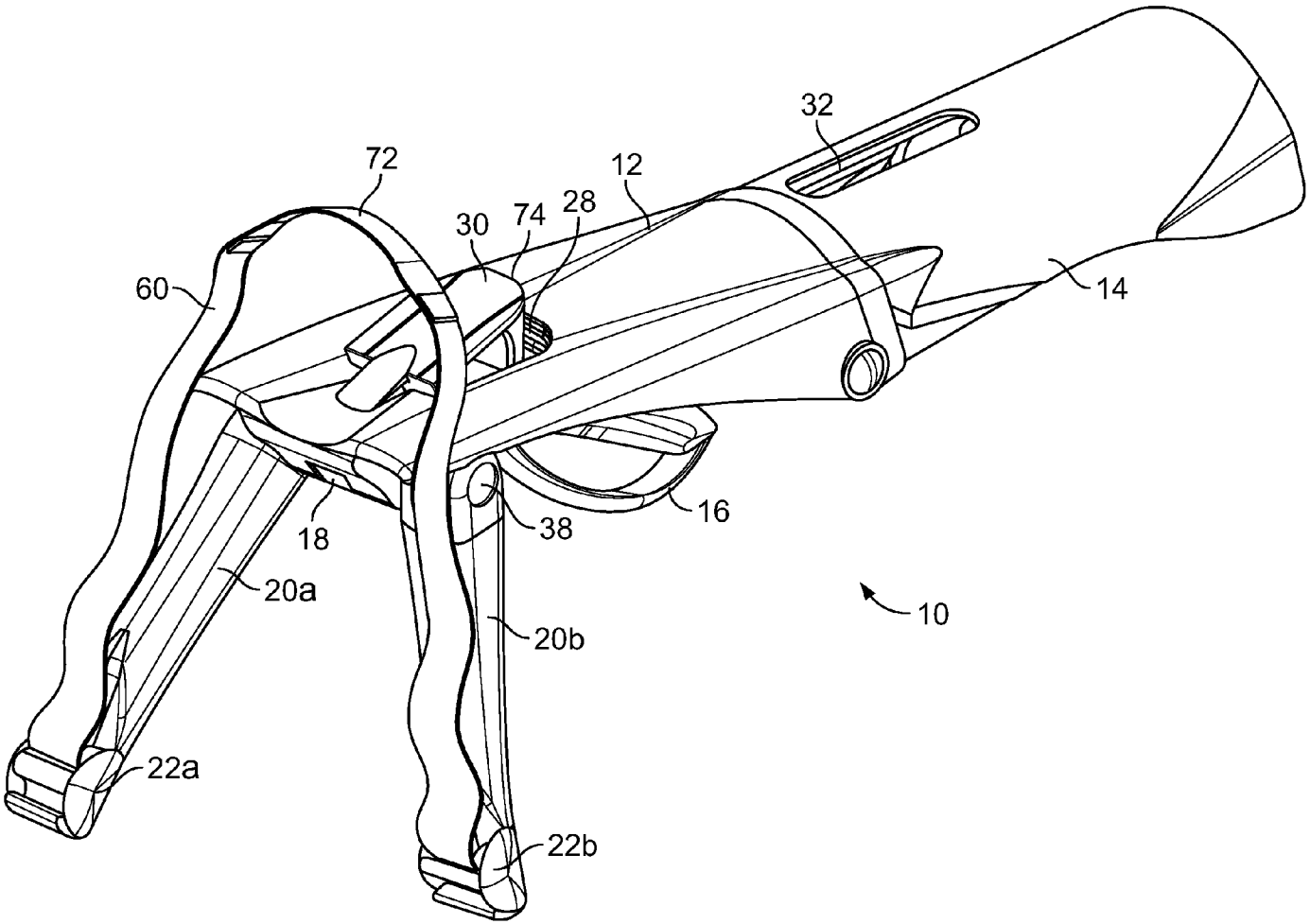
FIG. 5 is a perspective view of the collapsible locking slingshot of the present invention as shown in a partially open configuration, with the rear panel fully extended, the arms partially extended, and the handle partially extended.
Figure 6:
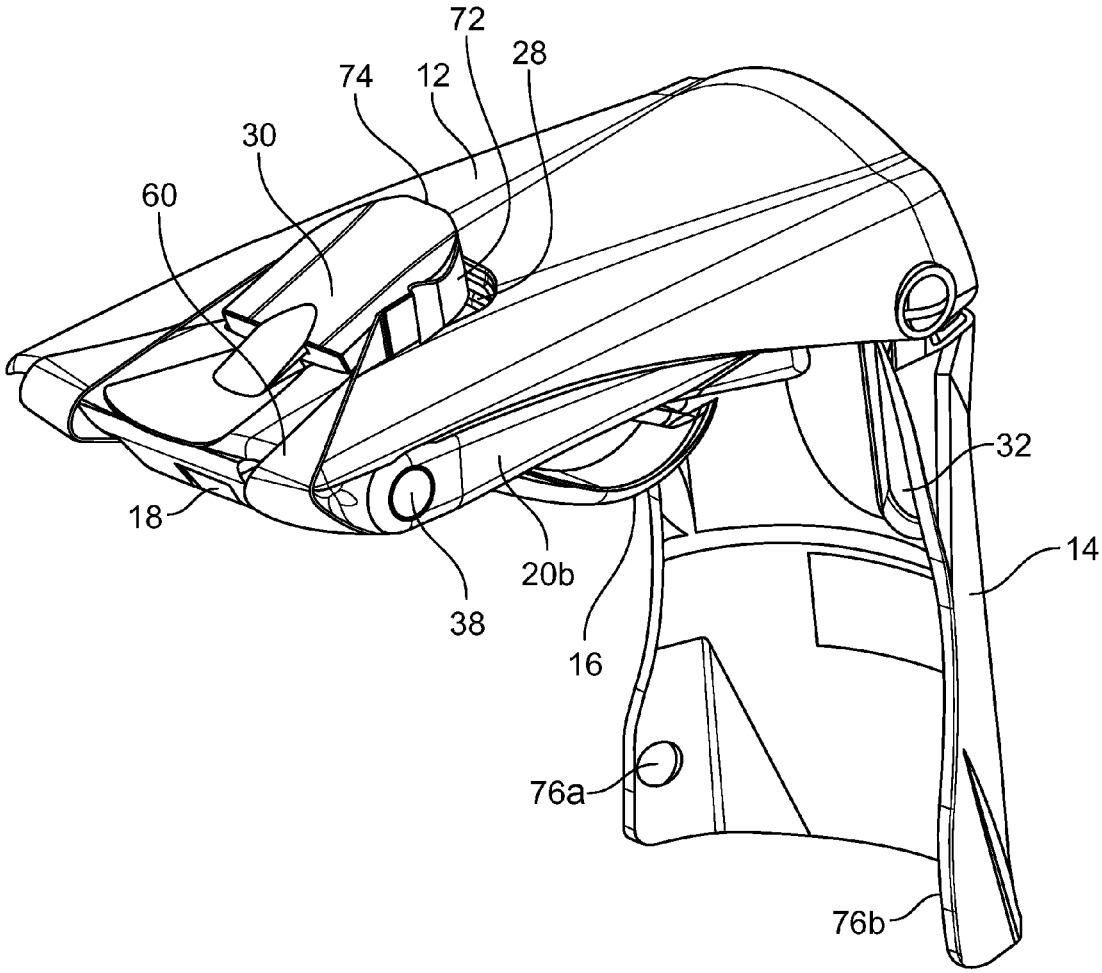
FIG. 6 is a perspective view of the collapsible locking slingshot of the present invention as shown in a partially open configuration, with the rear panel partially extended.
Figure 7:
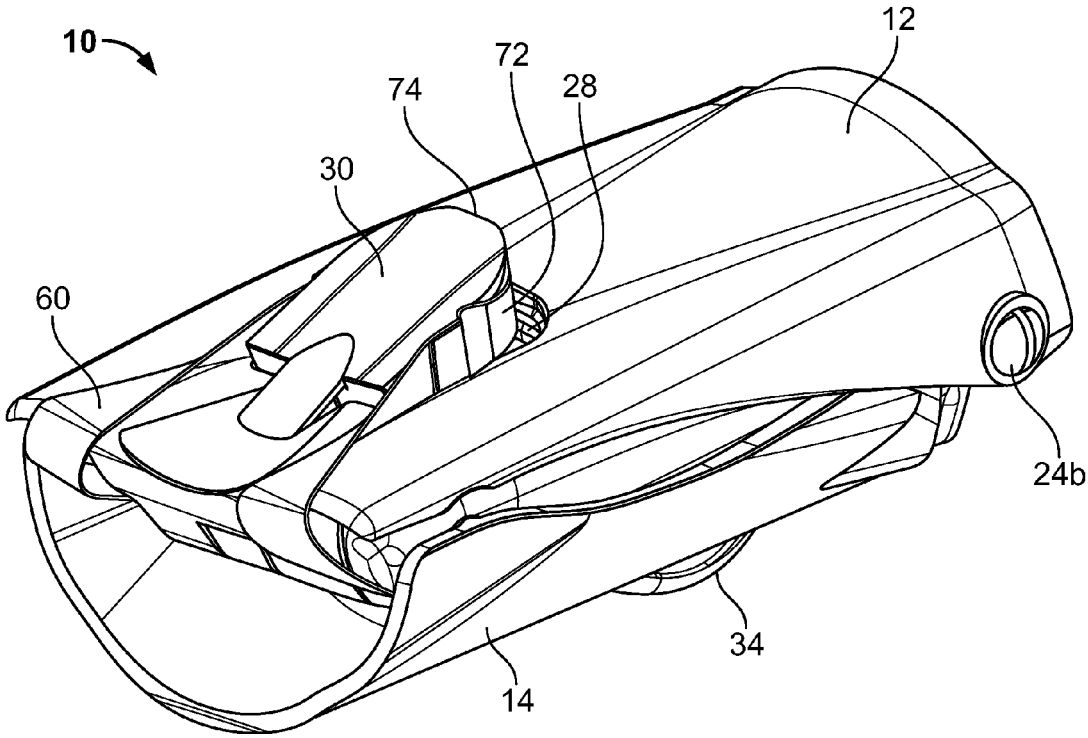
FIG. 7 is a perspective view of the collapsible locking slingshot of the present invention as shown in a fully folded and closed configuration.

FIGS. 5, 6, and 7 illustrate the collapsible locking slingshot of the present invention as it collapses from a fully open configuration, in FIG. 4, to a fully collapsed configuration, in FIG. 7. As shown in FIG. 3, the collapsible locking slingshot's primary structural components, the front panel 12, the rear panel 14, the arms 20*a* and 20*b*, and the handle 16, are connected using hinges and snap locks, which allows the device 10 to maintain its fully open configuration until the components are snapped closed. As shown in FIG. 5, the first step to collapse the collapsible locking slingshot 10 of the present invention is to rotate the arms 20*a* and 20*b* downward, toward the underside of the front panel 12, and to rotate the handle 16 upward so that the upper portion 30 of the handle 16 is protruded through the port 28 in the rear panel 14. Next, as shown in FIG. 6, the arms 20*a* and 20*b* are fully rotated toward the underside of the front panel 12, on either side of the handle 16 in a sandwiched configuration, while the band 60 (shown with an attached pocket 72) is directed around a lip 74 defined by the upper portion 30 of the handle 16 which is protruding through the port 28 on the front panel 12. This allows the band 60 to remain relatively immobile and protected when the slingshot is collapsed. Also, as shown in FIG. 6, the rear panel 14 is rotated toward the underside of the front panel 12. Finally, as shown in FIG. 7, the rear panel 14 is fully rotated toward the underside of the front panel 12 and positioned in a generally parallel configuration to the front panel 12, with the part 34 of the lower portion 36 of handle 16 protruding through the rear port 32 in the rear panel 14. In this closed configuration, the rear panel 14 is held in place by the frictional engagement of dimple recesses 76*a* and 76*b* on the inner side of the rear panel 14 with the ends 38 of the axle 18 which protrude through bores 40*a* and 40*b* of the arms 20*a* and 20. This creates a protected inner cavity, between the front panel 12 and the rear panel 14 where the most delicate components of the collapsible locking slingshot 10 are protected.

As discussed above, the collapsible locking slingshot of the present invention incorporates a padlock locking bay into the design by allowing the part 34 of the lower portion 36 of the handle 16 to protrude through the port 32 in the rear panel 14. This allows the slingshot to be locked securely using virtually any size of padlock that fits in the exposed portion of the handle 16. Even if a padlock is not used, the rear panel 14 still snaps closed, as described above, to prevent accidental unfolding of the device 10. The closed case also forms a protective housing for the delicate band 60 and pouch 72, shielding them from abrasion and ultraviolet radiation. This extra level of protection extends the life of the band 60 and the pouch 72, since slingshots generally are used far less than they are unused.

Figure 8:
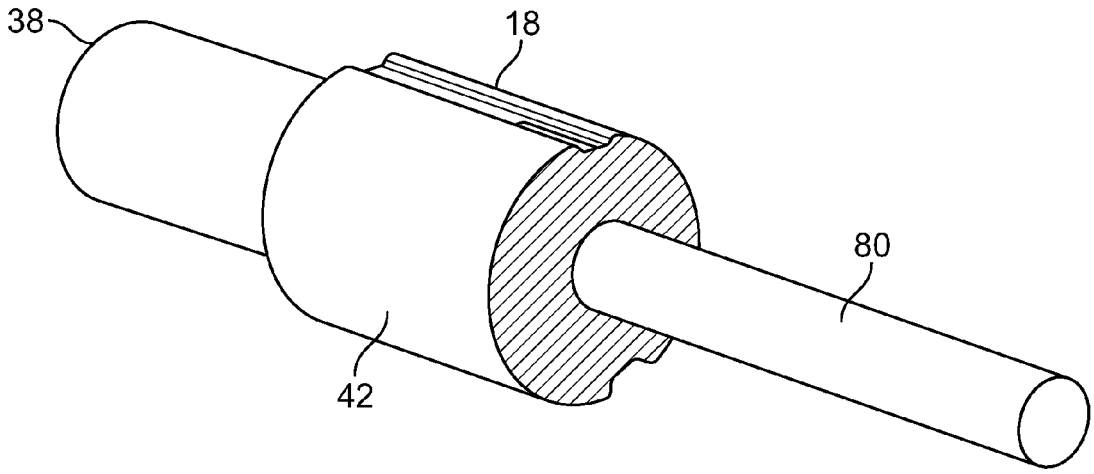
FIG. 8 is a partial cross-sectional view of the axle of the collapsible locking slingshot of the present invention showing the internally-embedded, metal-core axis.

An important safety feature of the collapsible locking slingshot 10 of the present invention is the ability of the device to be detected by metal detectors at airports and other locations. It is relatively easy to design a plastic slingshot with no metal parts, or with only a few small metal parts, which easily can go undetected by metal detectors. However, as shown in FIG. 8, the present invention integrates a large metal core 80 within the axle 18. The metal core 80 creates the strong positive metal detector signature necessary to alert a security officer. The metal core 80 also provides an added level of strength to axle 18, engineered to be the strongest component of the slingshot.

Self-Centering, Open-Pocket Pouch

Figure 9:
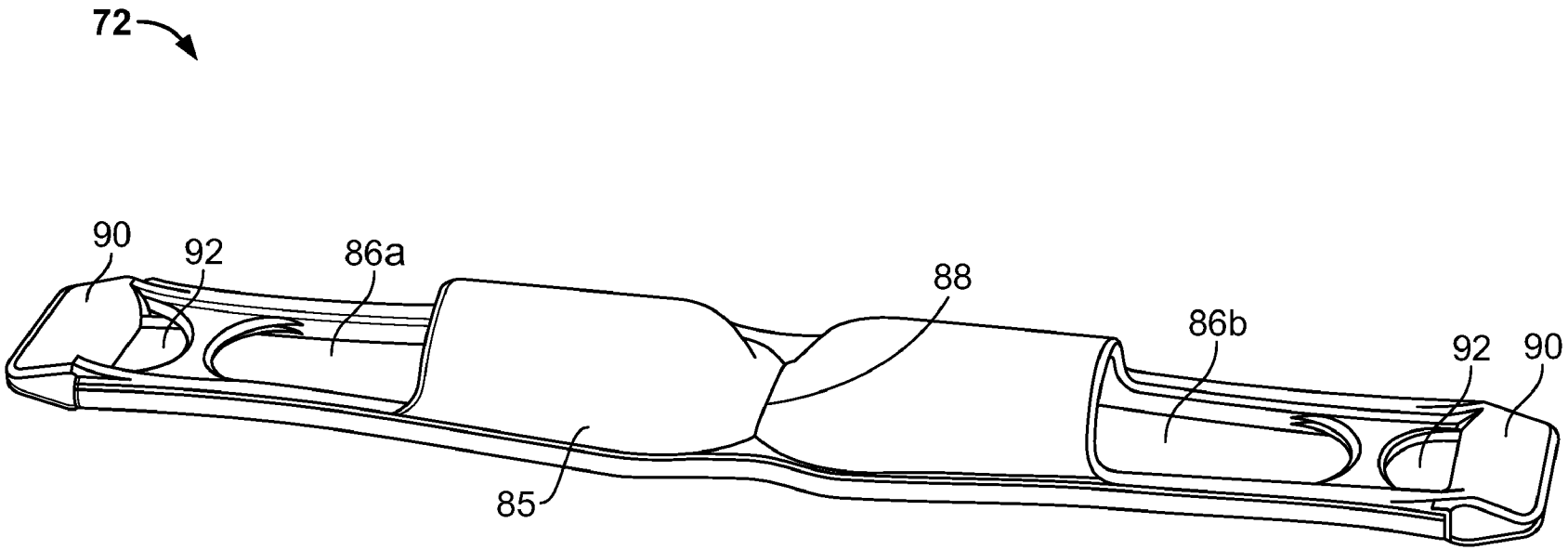
FIG. 9 is a perspective view of the self-centering, open-pocket pouch of the present invention shown in a fully open configuration.
Figure 10:
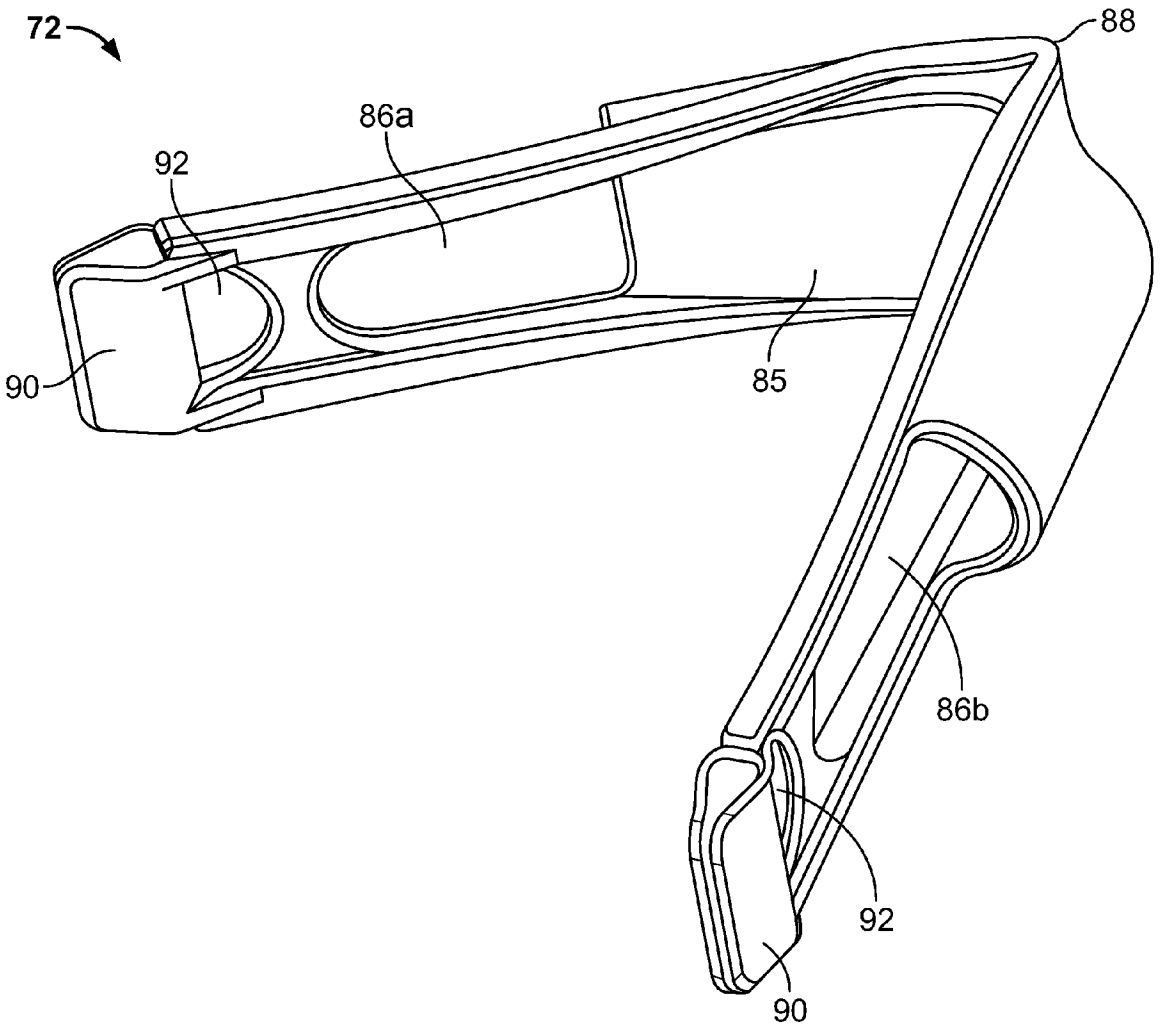
FIG. 10 is a perspective view of the self-centering, open-pocket pouch of the present invention shown in a partially folded configuration.

The present invention includes a self-centering, open-pocket pouch 72, which may be used in conjunction with the collapsible locking slingshot described above, or with prior art slingshots. As shown in FIGS. 9 and 10, the self-centering, open-pocket pouch of the present invention is about ⅝ inch wide and is constructed of polyethylene (Noveon's Estane 58134). The choice of material, small size, and skeletal design results in a dramatically lighter pouch than conventional prior art designs. This weight reduction results in a faster slingshot.

The pouch 72 includes a centered pouch section 85, which is designed with two integrated exit ports 86*a* and 86*b*, one on each side of the centered pouch section 85 joined by a central flexing live-hinge 88 (other embodiments could include multiple live-hinge configurations). The ports 86*a* and 86*b* permit the ammunition to exit the centered pouch section 85 without making contact against the sides of the pouch by allowing air to enter the pouch and expand the pouch outward, away from the ammunition (much like a parachute opening). The centered pouch section 85 is molded substantially flat, which helps it open along with the air pressure. Reduction or elimination of side pouch contact dramatically improves shot accuracy since any contact along the sides will either deflect the ammunition path or apply spin to the ammunition (typically a ball, pellet, or multiple pellets) causing it to curve much the same way a pitcher applies spin to a baseball to make it curve in its path. The ports 86*a* and 86*b* can be elliptical in shape, extremely elongated elliptical in shape, or can be empty of material as shown in FIGS. 9 and 10.

However, regardless of the shape of the ports 86*a* and 86*b*, the design of pouch 72 takes advantage of the user's need to grip the pouch during the firing process to automatically center the ammunition within it. By necessity, a user's fingers will pinch the forward opening of centered pouch section 85 closed during use, since the user must grip the pouch in front of the ammunition in order to hold the pouch during the firing process. This gripping process, in conjunction with the radii in the rear section of centered pouch section 85, provides a nesting area for the ammunition during the launch phase. This nesting area cradles the ammunition in a generally centered configuration within the pouch. Because it is centered within the centered pouch section 85, upon release the ammunition is less likely to contact either side of the pouch and, therefore, is less likely to be deflected. This results in a more accurate and predictable shot.

The pouch 72 also includes a pair of ends 90, each an aperture 92 to permit the band 60 to slip through the apertures 92 and allow the pouch 72 to be used with the band 60.

Dual-Tapered Band

Figure 11:
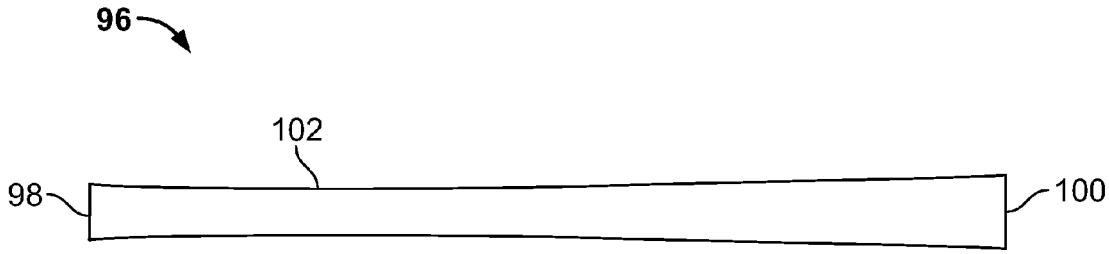
FIG. 11 is a side elevational view of the dual-tapered band of the present invention.

The present invention may also include a uniquely-engineering dual-tapered band 96, as shown in FIG. 11. Tapered bands are well known in the prior art as they allow the thinnest and lightest section of the band to end up by the pouch, thus reducing the mass-for greater speed-and sequencing the stretch, beginning with the thinnest, or narrow, section and progressing to the thicker, or wider section. This gives the band a smooth light pull. Prior art tapered bands can be flat or tubular but they have one major drawback, wear. The thin connecting point at the pouch end of the band focuses band flex right at the pouch. This results in abrasion between the pouch and band; thus, band life is reduced. The dual-tapered band of the present invention improves on prior art tapered band designs by increasing band life while maintaining the ease of pull and high velocity of prior art tapered bands.

The dual-tapered band 96 of the present invention has a unique double-taper. By tapering at both ends of the band 96, the pouch end 98 and the arm end 100, the thinnest area 102 of the band (the engineered failure point) is located away from the pouch, but towards the pouch end 98. Thus, the band flex is focused away from the pouch and over a greater area, decreasing band wear yet maintaining virtually all of the speed and smoothness of pull associated with tapered bands.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

The invention claimed is:

1. A slingshot comprising:

a first panel hinged at one end to a second panel, the first and second panels being moveable away from each other to form a guard area and being moveable towards each other to form a housing;

a pair of arms each having a first and second opposing ends, the first ends rotatably connected to one end of said first panel, the pair of arms being moveable away from the first panel such that said second ends extend away from the first panel, and being moveable towards the first panel such that when the panels form said housing the pair of arms are substantially contained within said housing;

a handle rotatably connected to said first panel, the handle being moveable to a downwardly extending position from the first panel and being moveable towards the first panel such that when the panels form said housing the handle is substantially contained within said housing; and a band used to sling a projectile having two ends separable secured to said second ends of each arm.

2. The slingshot of claim 1, wherein the panels have a curved shape such that when moved to form said guard area, a portion of the guard area is gauntlet shaped.

3. The slingshot of claim 1, wherein when the pair of arms is positioned away from the first panel such that said second ends extend away from the first panel, the pair of arms is generally planar to the first panel.

4. The slingshot of claim 1 further comprising:

an axle member positioned on one end of the first panel, wherein the first ends of the arms are attached to ends defined in the axle.

5. The slingshot of claim 4, wherein the axle includes a center region and wherein the handle includes a bore for rotatably attaching the handle to the center region of said axle, whereby the handle is rotatably attached the first panel.

6. The slingshot of claim 5 wherein the axle further includes a metal rod positioned therein.

7. The slingshot of claim 1, wherein the second panel includes a slot and the handle includes a lower section with an aperture defined therein, and when the handle is moved towards the first panel and said first and second panels are moved to form said housing the lower section and the aperture of the handle extends out of said slot, such that a locking mechanism is capable of sliding within the aperture to provide a means to lock the first and second panels together.

8. The slingshot of claim 1, wherein the first panel includes a port and the handle includes a top portion, and when the handle is moved towards the first panel the top portion of the handle extends out of the port in the first panel such that a portion of the band may be wrapped around the top portion.

9. The slingshot of claim 1 further comprising:

a groove defined in each second end of arm; and a clip cooperative with the groove to secure the ends of the band between the clip and groove.

10. The slingshot of claim 9 further comprising:

an aperture defined in each second end to accommodate the ends of the band such that a length of the band is adjustable.

11. The slingshot of claim 9 wherein the clip has a first end and a second end, and the first end having a smaller diameter than the second end, such that said first end accommodates a first band and said second end accommodates a second band, and the first band having a larger thickness than said second band.

* * * * *

UNITED STATES PATENT AND TRADEMARK OFFICE

CERTIFICATE OF CORRECTION

PATENT NO. : 7,484,505 B1
APPLICATION NO. : 11/302792
DATED : February 3, 2009
INVENTOR(S) : Charles Saunders It is certified that error appears in the above-identified patent and that said Letters Patent is hereby corrected as shown below:

Claim 1, Column 8, Lines 47-48 should read, "a band used to sling a projectile having two ends separably secured to said second ends of each arm."

Signed and Sealed this

Fifth Day of May, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,484,505 B1
APPLICATION NO. : 11/302792
DATED : February 3, 2009
INVENTOR(S) : Charles Saunders It is certified that error appears in the above-identified patent and that said Letters Patent is hereby corrected as shown below:

In column 4, line 24, the phrase "of a shooter's arm when in the opened on un-collapsed configuration" should read "of a shooter's arm when in the opened or un-collapsed configuration".

Signed and Sealed this
First Day of May, 2012

David J. Kappos

David J. Kappos
*Director of the United States Patent and Trademark Office*